US009562389B2

(12) United States Patent
Badger

(10) Patent No.: US 9,562,389 B2
(45) Date of Patent: Feb. 7, 2017

(54) PLUGLESS GLAZING SYSTEM

(71) Applicant: Provia Products, Sugarcreek, OH (US)

(72) Inventor: Chad Badger, Fredericksburg, OH (US)

(73) Assignee: PROVIA PRODUCTS, LLC, Sugarcreek, OH (US)

( * ) Notice: Subject to any disclaimer, the term of this patent is extended or adjusted under 35 U.S.C. 154(b) by 0 days.

(21) Appl. No.: 14/564,515

(22) Filed: Dec. 9, 2014

(65) Prior Publication Data

US 2015/0247355 A1 Sep. 3, 2015

Related U.S. Application Data

(60) Provisional application No. 61/914,187, filed on Dec. 10, 2013.

(51) Int. Cl.
*E06B 3/58* (2006.01)
*E06B 3/54* (2006.01)

(52) U.S. Cl.
CPC ..... *E06B 3/5892* (2013.01); *E06B 3/549* (2013.01)

(58) Field of Classification Search
CPC ..... E06B 3/549; E06B 3/5892
See application file for complete search history.

(56) References Cited

U.S. PATENT DOCUMENTS 3,342,001 A * 9/1967 Arnd ..... E06B 3/305 52/775
3,566,565 A * 3/1971 Pond ..... E06B 3/5864 49/505
3,641,721 A * 2/1972 Martin ..... E06B 3/685 52/212
3,903,669 A * 9/1975 Pease, Jr. ..... E06B 3/5892 411/339
4,241,556 A * 12/1980 Bursk ..... E06B 3/5892 49/171
5,018,330 A * 5/1991 Lewkowitz ..... E06B 3/5892 52/455
5,325,648 A * 7/1994 Menard ..... E06B 1/70 49/471
5,577,355 A * 11/1996 Leonelli ..... E06B 3/5892 52/204.591
5,636,484 A * 6/1997 DeBlock ..... E06B 3/5892 52/171.1
6,016,632 A * 1/2000 McGee ..... E04B 2/7455 52/241
6,151,849 A * 11/2000 Twigg ..... E06B 3/5892 52/204.53
6,318,037 B1 * 11/2001 Hansen ..... E06B 1/30 52/204.54

(Continued)

*Primary Examiner* — Patrick Maestri
(74) *Attorney, Agent, or Firm* — McDonald Hopkins LLC

(57) ABSTRACT

The present invention involves an entry door having a window glass situated in a door slab and a space between the window glass and the door slab. A plugless locking system is configured to fit in the space between the window glass and the door slab. The plugless locking system has a first plugless lock is configured to receive an external trim and is configured to mate with a second plugless lock. The second plugless lock is configured to receive an interior trim. The combination of the mated first and second plugless lock fit within the space between the window glass and door slab and secure interior and exterior trim to the entry door. Also disclosed is a method for using the plugless locking system in an entry door.

18 Claims, 12 Drawing Sheets

(56) References Cited

U.S. PATENT DOCUMENTS

| | | | | |
|---|---|---|---|---|
| 8,042,316 | B2 * | 10/2011 | Lee | E06B 3/5892 52/204.71 |
| 2003/0000163 | A1 * | 1/2003 | Lamanna | E06B 3/5892 52/204.62 |
| 2003/0066256 | A1 * | 4/2003 | DeBlock | B32B 17/10 52/208 |
| 2005/0055906 | A1 * | 3/2005 | Barnard | E06B 3/5892 52/204.1 |
| 2006/0198124 | A1 * | 9/2006 | Copland | E06B 3/5892 362/145 |
| 2007/0193140 | A1 * | 8/2007 | Carnick | E06B 3/5892 52/208 |
| 2008/0209826 | A1 * | 9/2008 | Hodges | E06B 3/5892 52/204.7 |
| 2008/0245003 | A1 * | 10/2008 | Kon | E06B 3/5892 52/208 |
| 2010/0229500 | A1 * | 9/2010 | Lynch | E06B 3/5892 52/784.13 |

* cited by examiner

PLUGLESS GLAZING SYSTEM

CROSS-REFERENCE TO RELATED APPLICATION

This application claims benefit from U.S. Provisional Patent Application No. 61/914,187, entitled "Plugless Glazing System," filed on Dec. 10, 2013, which is hereby incorporated in its entirety by reference.

FIELD OF INVENTION

The present invention relates generally to a glazing system for door, and more particularly, to a plugless glazing system for a door.

BACKGROUND

Entry doors for residences, business, and industrial facilities utilize entry doors of various designs. One popular design is a door designed with a window inset in the door. An entry door with a window often utilizes window trim in addition to the glass panel. In standard designs, two mating parts attach to oppose pieces of window trim. The first mating part attaches to the exterior window trim, holding the glass, trim, and the door slab together. The second mating part attaches to the interior window trim and locates and mates with the part attached to the exterior window trim.

Standard designs require external screws or other fasteners to secure the interior trim to the exterior trim. The use of external screws requires the use of trim plugs or other means to improve the aesthetic appearance of the interior trim. As trim plugs are painted and stained separately from the trim, this can lead to differences between the shade, hues, and glosses of the trim and trim plugs. Additionally, it is time consuming to prepare individual trim plugs for painting and staining.

It is also time consuming to install trim plugs during the door assembly process as one door may require up to 26 trim plugs. The trim plugs need to be installed carefully so that they properly cover the screw heads and that they attach to and blend in with the interior trim. Improperly fitted trim plugs can cause paint and/or stain chipping, marring or hazing, which leads to a potentially inferior finish to the door.

Therefore, there is a need for a more efficient connection system for entry door window trim. Specifically, there is a need for a plugless trim system that provides a better finish and is more aesthetically pleasing.

SUMMARY

Provided is a plugless locking system for attaching trim over a space between a glazing member and a framing member, the plugless locking system includes a first plugless lock that is configured to attach to an exterior trim. The first plugless lock may include a base having an exterior side and an opposite interior side, the exterior trim may be configured to attach to the exterior side of the base. A first member may extend from the interior side of said base and a second member may extend from the interior side of said base and be generally parallel to said first member. A cavity may be defined by the base, the first member and the second member. A first arm may extend from said first member, said first arm configured to operatively engage a surface of the glazing member and a second arm may extend from said second member, said second arm configured to operatively engage a surface of the framing member. At least one aperture may be provided within the first plugless lock.

A second plugless lock may be configured to attach to an interior trim, wherein the second plugless lock attaches with said first plugless lock, the second plugless lock includes a branch configured to be at least partially received within said cavity of the first plugless lock. At least one flange member may extend from said branch, the flange member may be configured to operatively engage said aperture to attach said second plugless lock with said first plugless lock. The interior trim and the exterior trim may be positioned over the space between the glazing member and the framing member.

The second plugless lock includes a first flange member and second flange member wherein each flange member includes a first end having a clip and a second end including a groove. The grooves of the first and second flange members may be positioned opposite from the clips along the branch. The groove may be configured to abut against a mating profile of said interior trim to support the second plugless lock relative to the interior trim.

A fastener may attaches the first plugless lock to the exterior trim and another fastener may attach the second plugless lock to the interior trim wherein the fasteners may be concealed by the plugless locking system once the plugless locking system is installed within the space between the glazing member and the framing member. The first plugless lock and the second plugless lock may not be viewable once the plugless locking system is installed within the space between the glazing member and the framing member.

The branch includes a first flange member spaced from a second flange member, the first flange member includes a first clip configured to operatively engage a first aperture of the first plugless lock and the second flange member includes a second clip configured to operatively engage a second aperture of the first plugless lock. The first flange member may include a first groove extending from the branch opposite from the first clip and the second flange member may include a second groove extending from the branch opposite from the second clip. The grooves may be configured to abut against a mating profile of said interior trim to support the second plugless lock relative to the interior trim.

The first clip and second clip may be configured to bias relative to one another to operatively attach to the first and second apertures, respectively. The mating profile may include a space defined by a first rib and a second rib or may include a ridge that extends along the underside of the interior trim.

Provided by this disclosure is an entry door that includes a window glass positioned within a door slab, wherein there is a space between the window glass and the door slab. A plugless locking system is configured to fit in the space between the window glass and the door slab. The plugless locking system having a first plugless lock configured to receive an exterior trim, the first plugless lock includes a base having at least one aperture. A first member may extend generally perpendicularly from said base and a second member may extend generally perpendicularly from said base and generally parallel to said first member. A cavity may be positioned generally between said first and second members. A first ledge and a second ledge may extend from said first and second members, respectively. Said first and second ledges may be configured to operatively engage said window glass and door slab. A second plugless lock may be configured to receive an interior trim, wherein the second plugless lock attaches with said first plugless lock, the second plugless lock includes a branch configured to be received within said cavity. At least one clip may extend from said branch, the clip may be configured to operatively engage said aperture to attach said second plugless lock with said first plugless lock. At least one groove may extend from said branch and be positioned opposite said clip. The groove may be configured to abut against said interior trim.

The grooves may be configured to abut against a mating profile of said interior trim to support the second plugless lock relative to the interior trim. The mating profile may include a space defined by a first rib and a second rib. The mating profile may include a ridge that extends along the underside of the interior trim.

A fastener may attach the first plugless lock to the exterior trim and another fastener may attach the second plugless lock to the interior trim wherein the fasteners are concealed by the interior trim and the exterior trim when the plugless locking system is installed within the space. The first plugless lock and the second plugless lock may not be viewable once the plugless locking system is installed within the space between the glass window and the door slab.

Also provided is a method for attaching an interior trim and an exterior trim to an entry door having a window glass, the method includes the steps attaching an exterior trim to a first plugless lock configured to receive the exterior trim through the use of at least one fastener. The combination of the exterior trim and the first plugless lock may be inserted into a space between a door slab and window glass on an exterior surface of the entry door, with the first plugless lock end being inserted first and upon complete insertion, the exterior trim resting on the exterior surface of the entry door and an exterior surface of the window glass. An interior trim may be attached to a second plugless lock configured to receive the interior trim through the use of at least one fastener. The combination of the interior trim and the second plugless lock may be inserted into a space between the door slab and window glass on an interior surface of the entry door, with the second plugless lock end being inserted first and, upon complete insertion, the interior trim resting on the interior surface of the entry door and an interior surface of the window glass. The first plugless lock may be mated with the second plugless lock in the space between the door slab and window glass of the entry door.

In one embodiment, a groove of the second plugless lock is inserted within a mating profile of the interior trim and the second plugless lock may be attached to the interior trim with a fastener.

In another embodiment, a ridge of a mating profile of the interior trim is mated with a groove of the second plugless lock and the second plugless lock may be attached to the interior trim with a fastener.

BRIEF DESCRIPTION OF THE DRAWINGS

Operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1B:
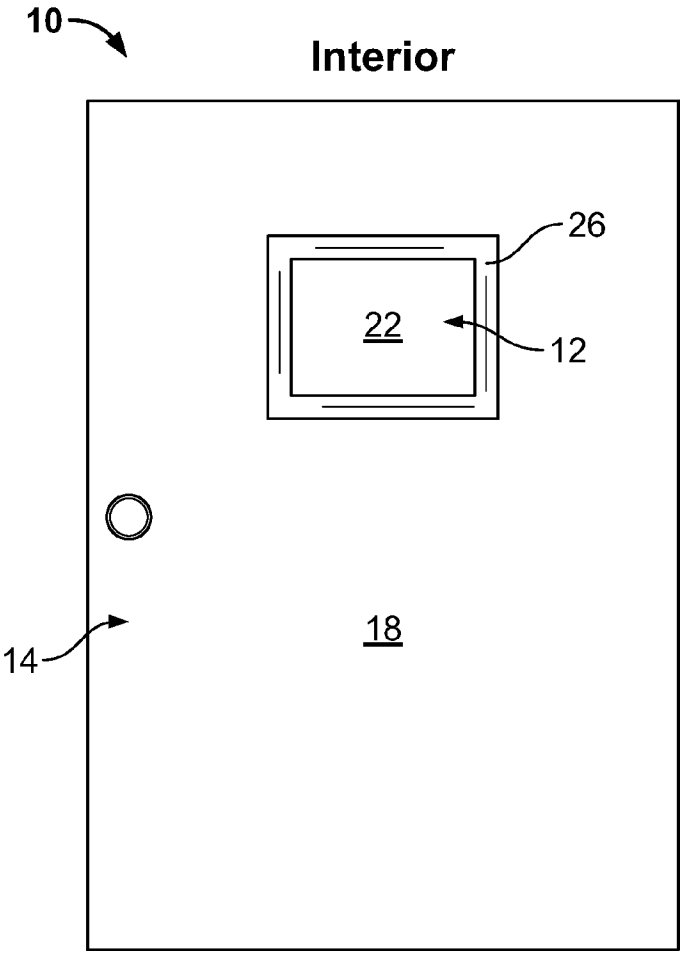
FIG. 1B is an interior view of the entry door.
Figure 1A:
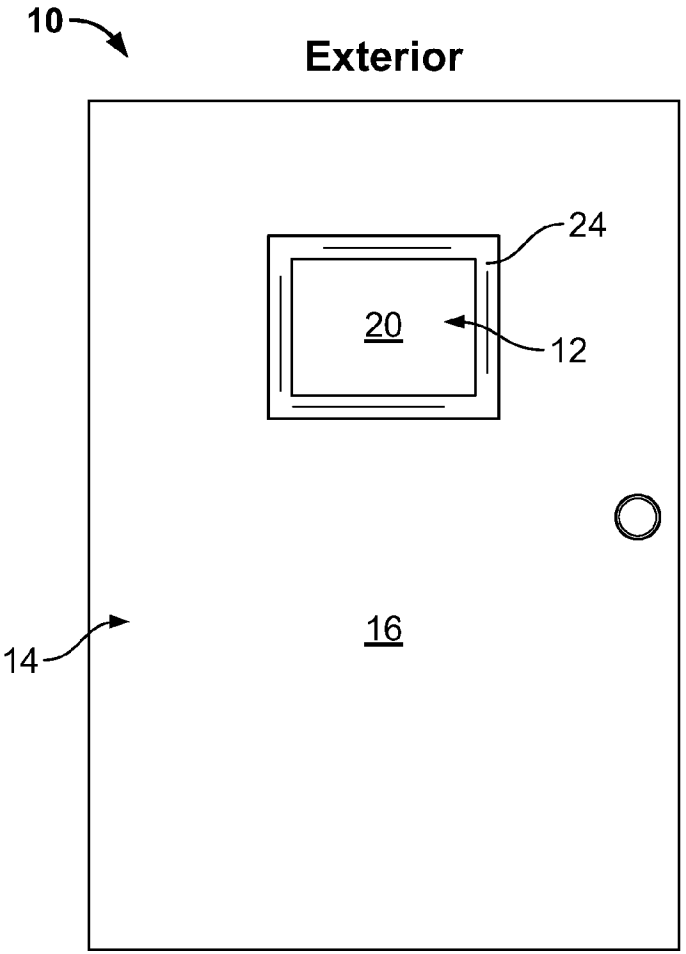
FIG. 1A is an exterior view of an entry door.

An entry door 10 capable of being attached to a building structure, the entry door 10 having a window glass 12, is shown in FIG. 1A. The entry door 10 may be of any appropriate shape and size, the present teachings are not limited to the shape and size of the entry door 10 shown and described herein. The window glass 12 may be of any appropriate shape and size, the present teachings are not limited to the shape and size of the window glass 12 shown and described herein. Further, the window glass 12 is not limited to glass; it may also be plastic or any other suitable material. The window glass 12 may be clear, colored, opaque, or any combination of such. Further, the window glass 12 may be comprised of multiple pieces, e.g., a stained glass window design. These, however, are merely exemplary embodiments of the entry door 10 and window glass 12—any appropriate door or window glass may be used with the present teachings. While the entry door 10 is shown and described as being a door to enter a structure, it may also be an internal door, closet door, or any other type of door; the present teachings are not limited to the use and type of door shown and described.

When terms such as "interior," "exterior," "inner," "outer," "lower," "upper," "horizontal," and "vertical" are used herein, reference is made to the entry door 10 of the present teachings when oriented as shown, for example, in FIGS. 1A and 1B. It should be understood that such terms are used in their relative senses and are intended to be and are merely exemplary and not all-inclusive nor exclusive.

As shown in FIGS. 1A and 1B, the entry door 10 may have a door slab 14, which may be formed from a variety of materials, including, but not limited to, wood, plastic, steel, fiberglass, aluminum or any other appropriate material—or it may be a combination of any such material. The entry door 10 may have an exterior surface 16 and an interior surface 18. When the entry door 10 is used as an entry door to a building, for example, the exterior surface of the door 16 is the side of the door exposed to the outside of the building. In this situation, the interior surface of the door 18 is exposed to the interior of the building.

The window glass 12 may also have an exterior surface 20 and an interior surface 22. The exterior surface of the window glass 20 may be exposed to the outside of the building in the example above. The interior surface of the window glass 22 may be exposed to the interior of the building.

The window glass 12 may have both an exterior trim 24 contacting the exterior surface of the door 16 and the exterior surface of the window glass 20 and an interior trim 26 contacting the interior surface of the door 18 and the interior surface of the window glass 22. The exterior and interior trims 24, 26 may be of any appropriate configuration. The exterior and interior trims 24, 26 may provide an aesthetically pleasing finish to the entry door 10. The exterior and interior trims, 24, 26 may be formed of any appropriate material, including, without limitation, wood, plastic, fiberglass, steel, aluminum, or any other material—or a combination of such materials.

Figure 2:
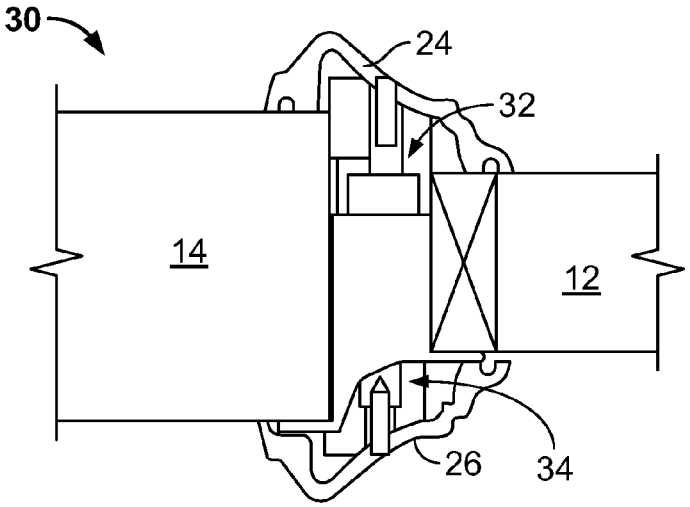
FIG. 2 is a cross-sectional view of an entry door with a window glass with a plugless locking system.
Figure 3A:
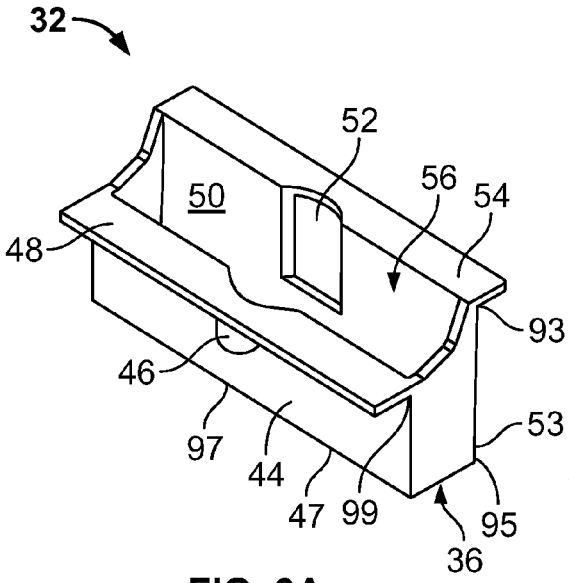
FIGS. 3A, 3B, 3C, and 3D are perspective views of various first plugless locks.
Figure 3B:
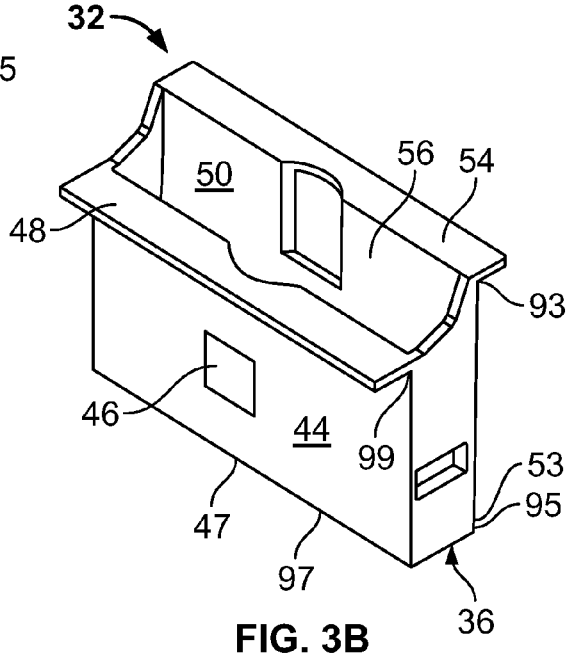
Figure 3C:
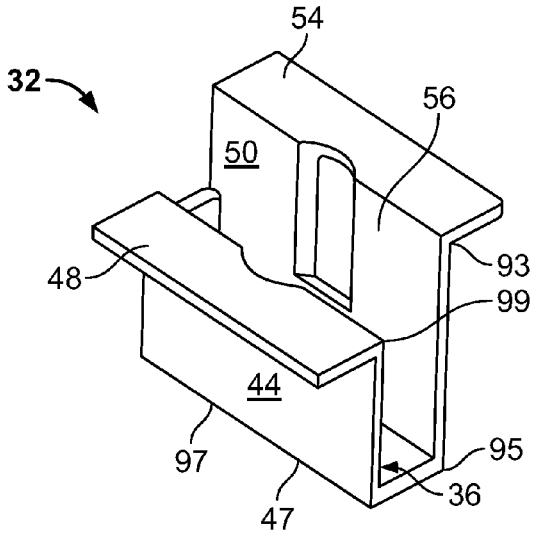
Figure 3D:
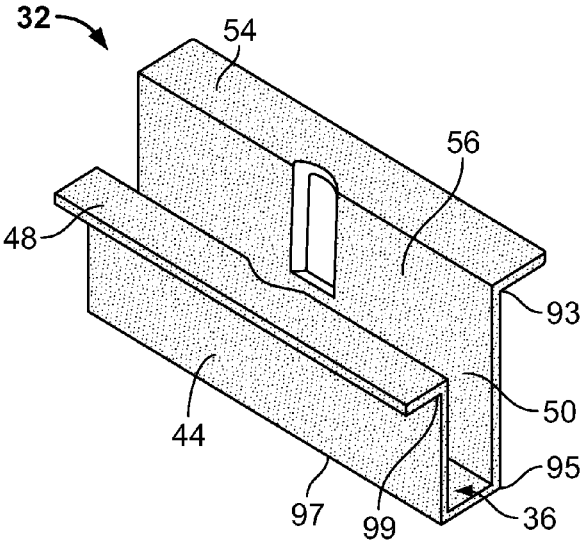
Figure 4:
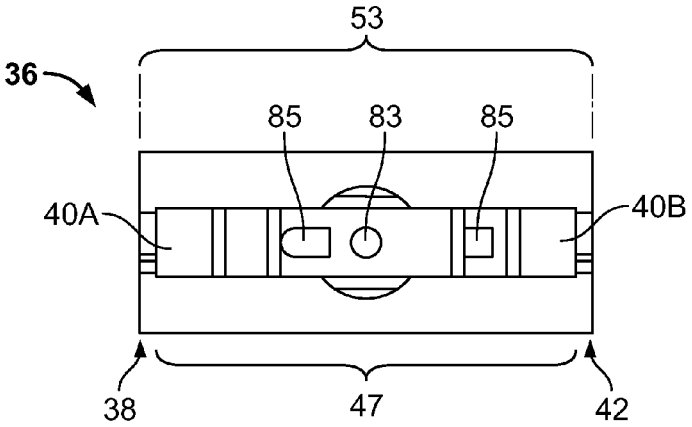
FIG. 4 is a bottom view of a first plugless lock.
Figure 5A:
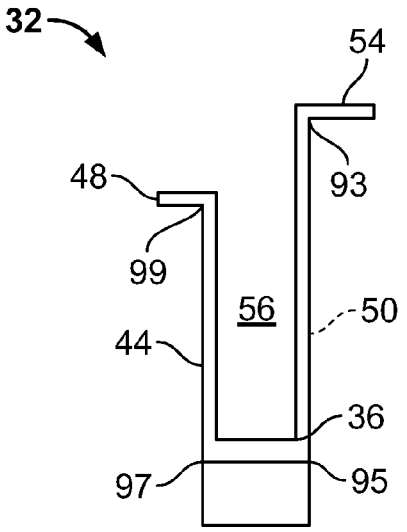
FIGS. 5A, 5B, and 5C are side views of various first plugless locks.
Figure 5B:
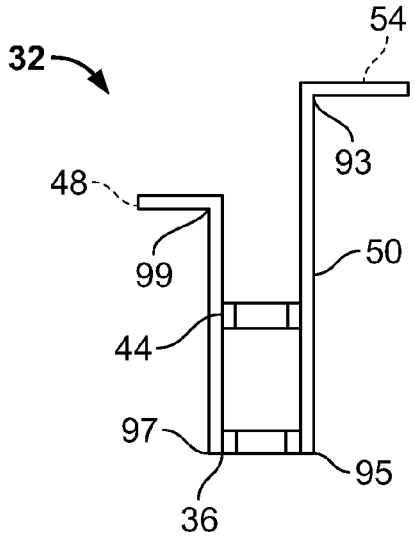
Figure 5C:
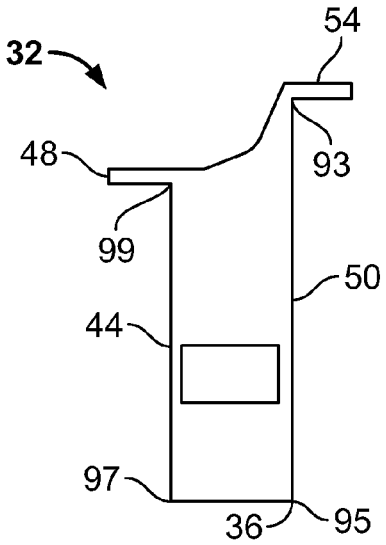

The window glass 12 may be secured to the door slab 14 by a plugless locking system 30 as shown in FIG. 2. The plugless locking system 30 may include a first plugless lock 32 and a second plugless lock 34.

As shown in FIGS. 3A-D, 4, and 5A-C, the first plugless lock 32 may be generally rectangular in shape with a base 36 having a width smaller than the distance between the door slab 14 and the window glass 12 in the entry door 10. The base 36 may have a first base end 38 having at least one aperture 40A and a second base end 42 opposite from the first base end 38 having at least one aperture 40B. The base 36 may have additional apertures 85 that may mate with the exterior trim 24 allowing for repeatable installation of the plugless locking system 30.

The first plugless lock 32 may also include a first side 44 of any appropriate configuration. The first side 44 may include a relief aperture 46 and a first side end 97 attached generally perpendicularly to the base 36 at a first base side 47. The first side 44 may also include a second side end 99 attached generally perpendicularly to a first ledge or arm 48. The first plugless lock 32 may further include a second side 50 having a relief aperture 52 and a first side end 95, which may be attached perpendicularly to the base 36 at the second base side 53. The second side 50 may also include a second side end 93 attached generally perpendicularly to a second ledge or arm 54. The first side 44 and the second side 50 may be generally parallel to one other, but are not limited to this configuration.

A cavity 56 may be formed between the first side 44 and the second side 50, the cavity 56 having a width generally equivalent to that of the base 36. Further, the first side 44 may be shorter than the second side 50 and accordingly, the first arm 48 and the second arm 54 may be at different elevations. However, the first plugless lock 32 may be of any appropriate configuration and is not limited to that shown and described herein.

As shown in FIGS. 6A-C, 7A-B, and 8A-b, the second plugless lock 34 may include a branch 58. The branch 58 may include a first flange member 60 positioned at one end of the branch 58 and a second flange member 62 position at an opposing end of the branch 58. The first flange member 60 may be spaced from the second flange member 62. A channel 64 may be defined by the space between the first flange member 60 and the second flange member 62 and bordered by the branch 58. The first flange member 60 may include a first end 66 having a first clip 68 and a second end 70 having a first groove 72. The first end 66 of the first flange member 60 and the first clip 68 may be configured to be received by the at least one aperture 40A of the base 36 of the first plugless lock 32.

Figure 6A:
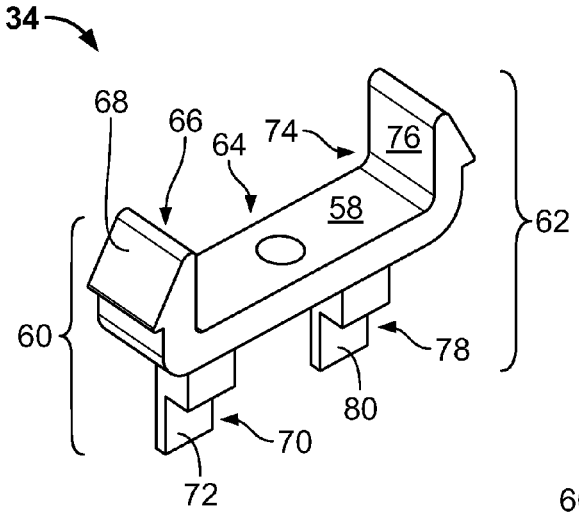
FIGS. 6A, 6B, and 6C are perspective views of various second plugless locks.
Figure 6B:
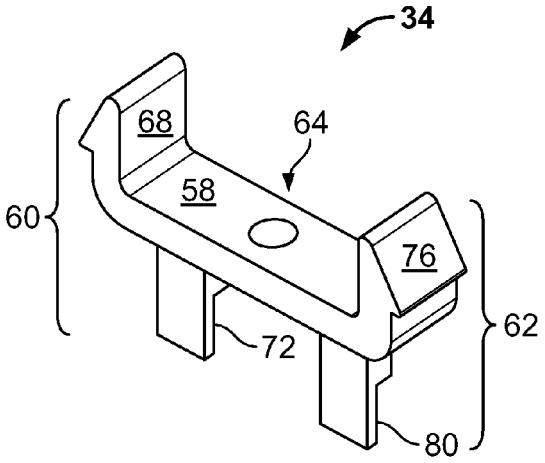
Figure 6C:
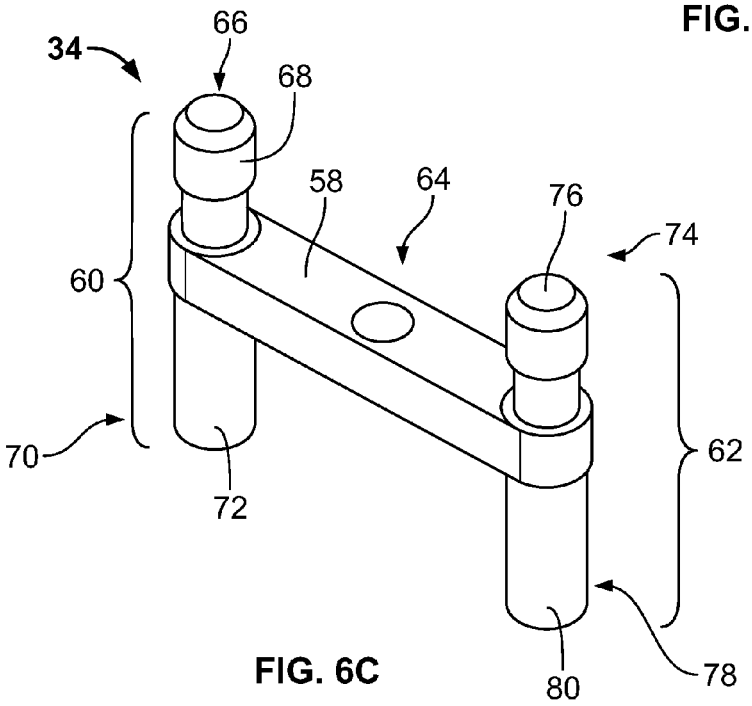
Figure 7A:
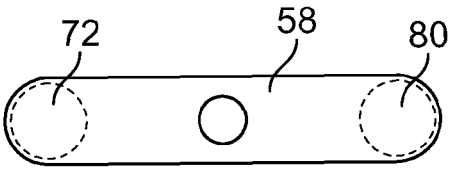
FIGS. 7A and 7B are bottom views of various second plugless locks.
Figure 7B:
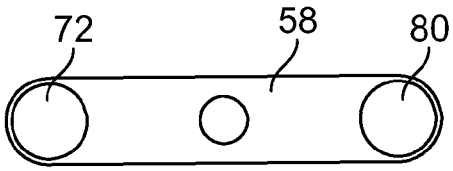
Figure 8A:
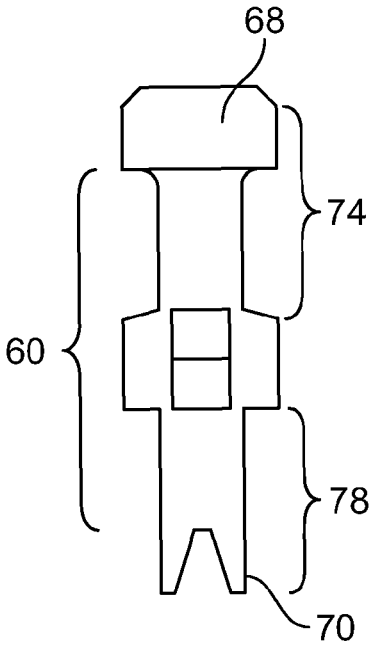
FIGS. 8A and 8B are side views of various second plugless locks.
Figure 8B:
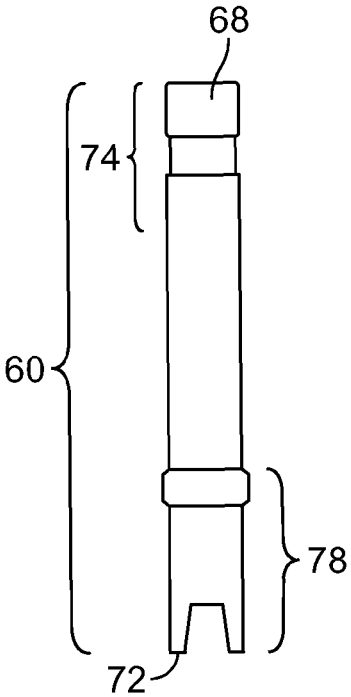

The second flange member 62 of the second plugless lock 34 may include a first end 74 having a second clip 76 and a second end 78 having a second groove 80. The first flange member 60 and the second flange member 62 may be generally parallel to one other, and both may extend at a substantially right angle from branch 58. In one embodiment, the first clip 68 may be opposite from the second clip 76 such that each clip may be biased relative to the other to be received within apertures as illustrated by FIGS. 6A and 6B. Both the first plugless lock 32 and the second plugless lock 34 of the plugless locking system 30 may be formed from a variety of materials, including, but not limited to, plastic, steel, fiberglass, aluminum or any other appropriate material or any combination of such. By way of a non-limiting example, the plugless locking system 30 may be formed from a strong UV resistant injection molded plastic or composite, such as acrylonitrile butadiene styrene (ABS) or polycarbonate (PC).

Figure 15A:
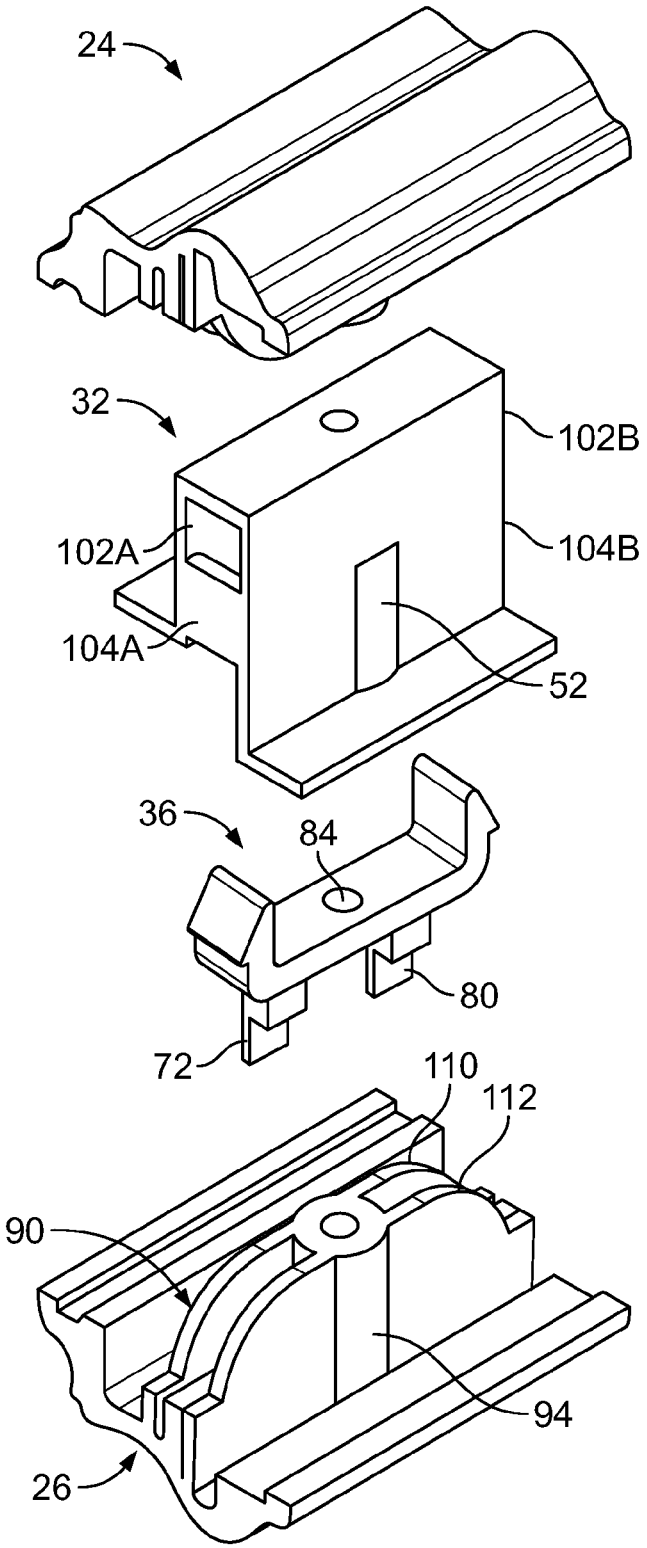
FIGS. 15A, 15B, 15C and 15D are exploded views of embodiments of the plugless locking system.
Figure 15B:
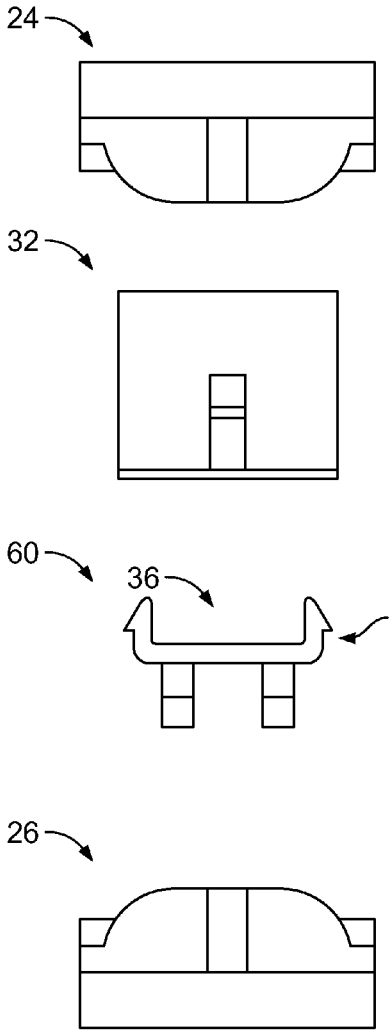
Figure 15C:
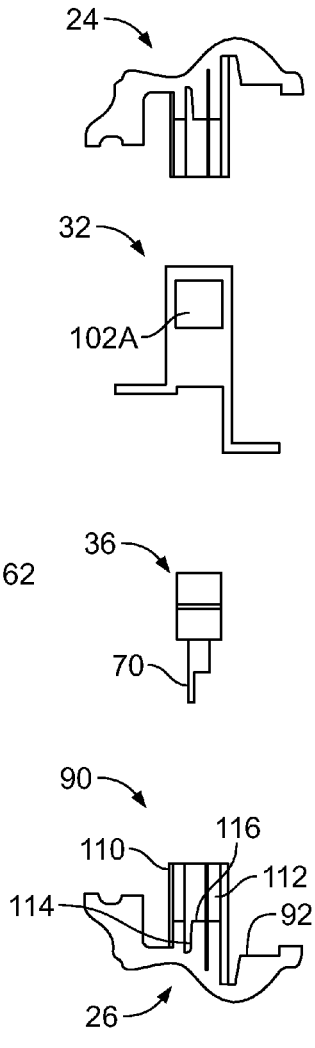
Figure 15D:
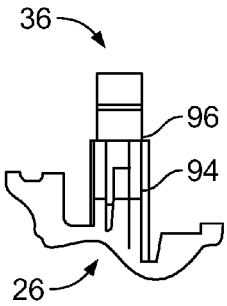

The exterior trim 24 may be attached to the base 36 of the first plugless lock 32 through the use of a fastener 82 operatively inserted through a central hole 83, as shown in FIGS. 4, 9A, 9B, 9C, 10A and 10B. The present teachings of the fastener 82 are not limited to the screw shown. Any appropriate fastener 82 may be used without departing from the present teachings. The exterior trim 24 may be formed from a variety of materials, including, but not limited to, plastic, metal, wood, or any other suitable material or combination of such. The fastener 82 may be any type of fastener, including, but not limited to, a screw, nail, nut, bolt, lag, or any other appropriate fastener. The fastener 82 may be inserted through aperture 83 as illustrated by FIGS. 2 and 15A. and is to be concealed from view once the interior trim 26 and the exterior trim 24 of the system are installed in place.

Similarly, as shown in FIGS. 11A, 11B, 11C, 12A, and 12B, the interior trim 26 may be attached to the second plugless lock 34 through the engagement with a mating profile 90 along an underside 92 of the interior trim 26 with the first groove 72 and the second groove 80 of the second plugless lock 34. In this embodiment, the mating profile 90 includes a ridge 122 that extends along the underside 92 of the interior trim 26 and is shaped to fit within the first and second grooves 72, 80. This configuration may prevent unwanted rotation between the interior trim 26 and the second plugless lock 34 as they are being attached. A fastener 82 may be operatively inserted through a central hole 84 of the second plugless lock 34. In one embodiment, the underside 92 of the interior trim 26 includes an extension portion 94 configured to receive the fastener 82 as it extends through the aperture 84 along the branch 58 of the second plugless lock 34. The extension portion 94 may extend from the underside 92 of the interior trim 26 and abut against the branch 58 as the fastener 82 is installed. The extension portion 94 may extend radially passed the edges of the branch 58 to form an overlap portion 96. The interior trim 26 may be formed from a variety of materials, including, but not limited to, plastic, metal, wood, or any other suitable material. The fastener 82 may be any type of fastener, including, but not limited to, a screw, nail, nut, bolt, lag, or any other appropriate fastener.

Figure 9A:
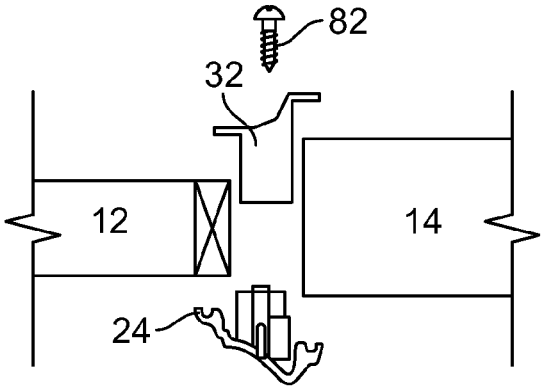
FIGS. 9A, 9B, and 9C are perspective views of a first plugless lock mating with an exterior trim.
Figure 9B:
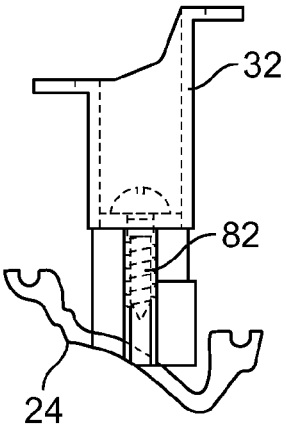
Figure 9C:
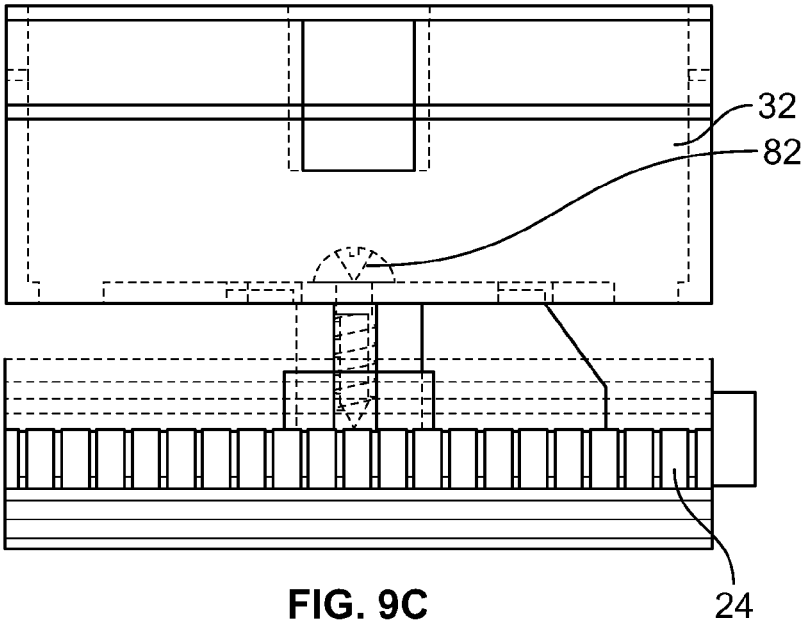
Figure 10A:
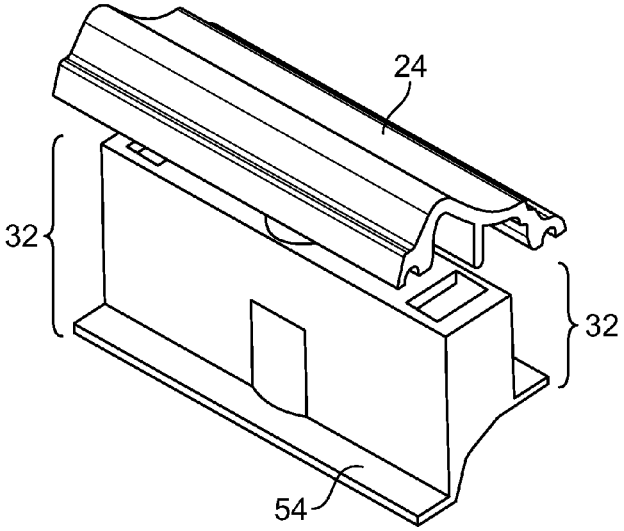
FIGS. 10A and 10B are perspective views of a first plugless lock mated with an exterior trim.
Figure 10B:
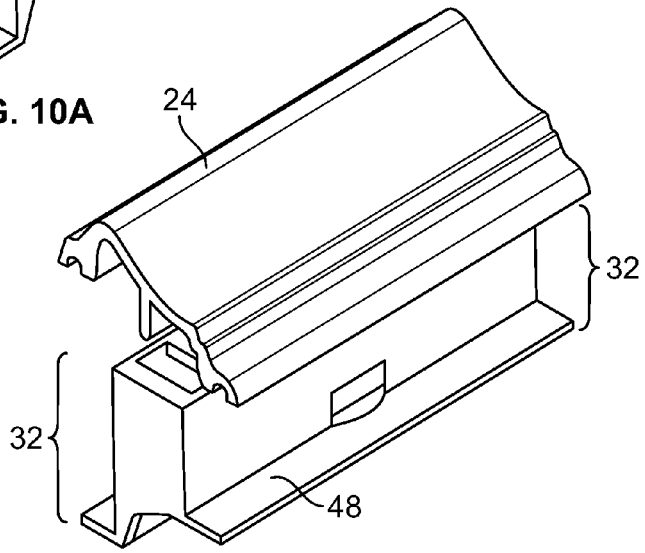
Figure 11A:
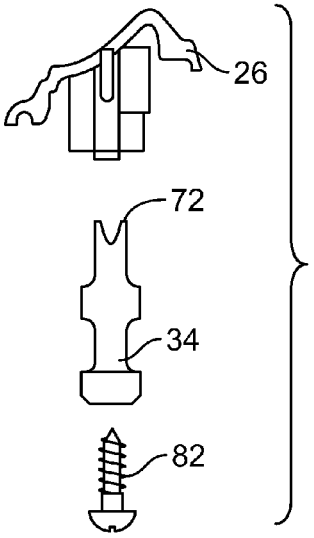
FIGS. 11A, 11B, and 11C are perspective views a second plugless lock mating with an interior trim.
Figure 11B:
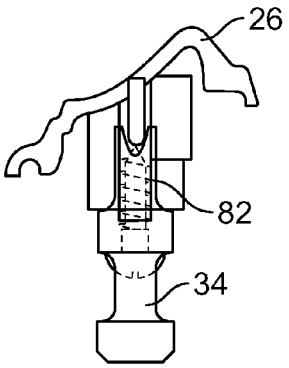
Figure 11C:
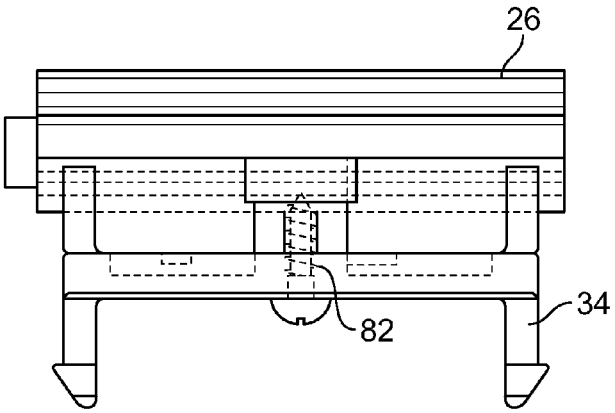
Figure 12A:
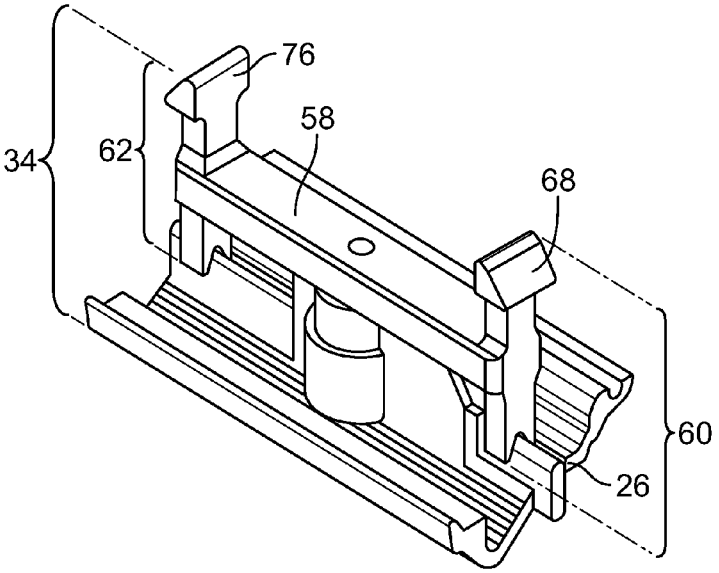
FIGS. 12A and 12B are perspective views of a second plugless lock mated with an interior trim.
Figure 12B:
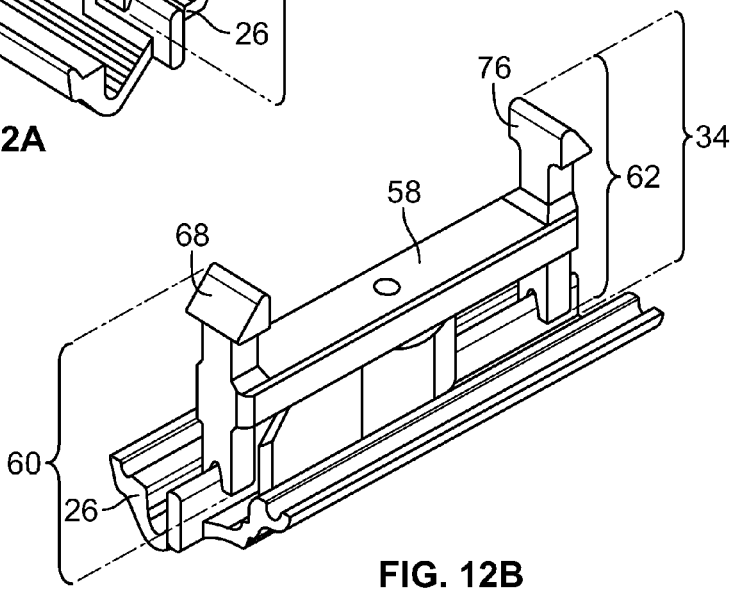
Figure 13:
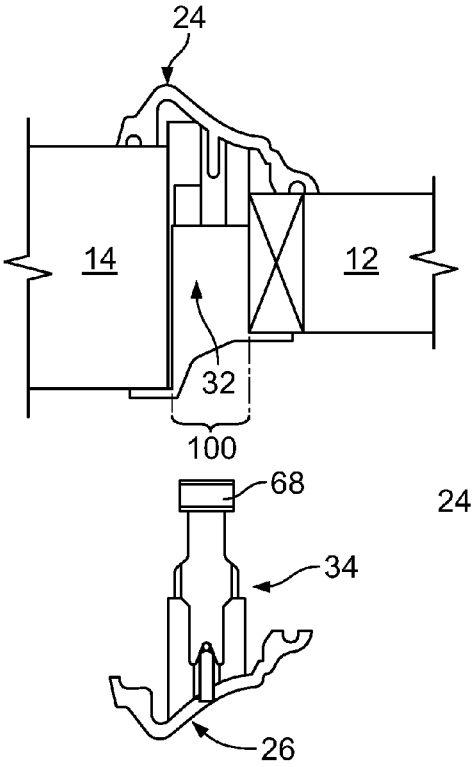
FIG. 13 is a side view of a plugless locking system being installed in an entry door.

The first plugless lock 32 may be configured to be received in a space 100 between the door slab 14 and the window glass 12 as shown in FIGS. 2, 9A and 13. The combination of the first plugless lock 32 and the attached exterior trim 24 may be inserted into the space 100, with the base 36 of the first plugless lock 32 leading. When fully inserted, the first plugless lock 32 may fit snugly between the window glass 12 and the door slab 14. The exterior trim 24 may rest on the exterior surface 16 of the door 14 and the exterior surface 20 of the glass 12. In one embodiment, a sealer material may be positioned between the exterior trim 24 and the exterior surfaces 16, 20. The sealer material may be a foam material or tape material applied to the trim 24 before installation. Additionally, the sealer material may be a silicone or other type of water based sealing material. The exterior trim 24 may bridge the space 100 between the door slab 14 and the window glass 12, creating a water tight seal on the entry door 10.

After insertion into the space 100, the first arm 48 of the first plugless lock 32 may abut the interior surface 22 of the window glass 12 and the second arm 54 of the first plugless lock 32 may abut the interior surface 16 of the door slab 18.

The second plugless lock 34 may also be configured to be received by the space 100 between the door slab 14 and the window glass 12. The second plugless lock 34 and the attached interior trim 26 may be inserted into the space 100, with the first clip 68 of the first flange member 60 and the second clip 76 of the second flange member 62 of the second plugless lock 34 leading. When fully inserted, the second plugless lock 34 may fit snugly between the window glass 12 and the door slab 14 with the interior trim 26 resting against the interior surface 18 of the door 14 and the interior surface 22 of the window glass 12. In one embodiment, a sealer material may be positioned between the interior trim 26 and the interior surfaces 18, 22. The sealer material may be a foam material or tape material applied to the trim 26 before installation. Additionally, the sealer material may be a silicone, polyurethane or other type of water based sealing material. This sealer material may be useful to reduce raddling of the trim.

Figure 14A:
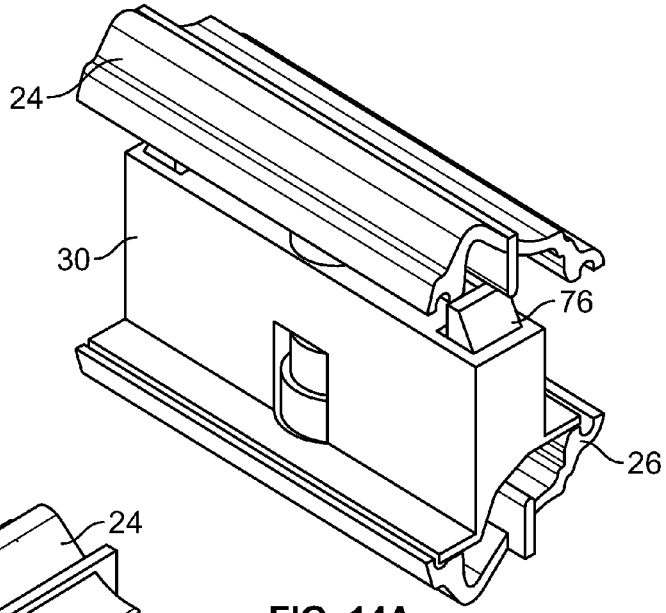
FIGS. 14A and 14B are perspective views of a plugless locking system mated without an entry door.
Figure 14B:
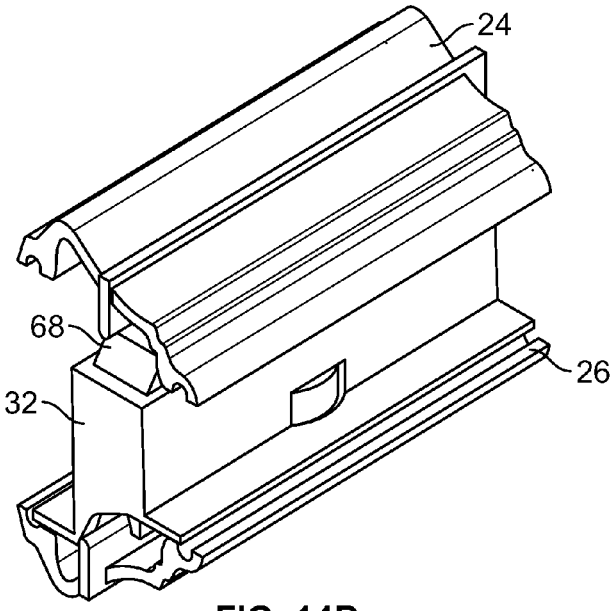

The second plugless lock 34 may be inserted inside the cavity 56 of the first plugless lock 32. The first end 66 of the first flange member 60 of the second plugless lock 34 may be inserted through the at least one aperture 40A of the first plugless lock 32. The first end 74 of the second flange member 62 of the second plugless lock 34 may be inserted through the at least one aperture 40B of the first plugless lock 32. First and second clips 68, 76 along the first ends 66, 74 respectively, may be flexible so that they may compress to pass through the at least one apertures 40A, 40B and expand upon exiting the at least one apertures 40A, 40B to generally resist opposing movement of the second plugless lock 34. The resulting mating combination of the first and second plugless locks 32, 34 may create a removable connection that allows for the replacement of the window glass 12, exterior trim 24, and/or interior trim 26. FIGS. 14A and 14B show this connection without the entry door 10, to show the mating of the first and second plugless locks 32, 34. Further, the second plugless lock 32 illustrated by FIGS. 6C, 8A, 8B, may be attached to interior trim 26 as illustrated by FIGS. 11A, 11B, 11C, 12A and 12B. This embodiment, is configured to be attached to the first plugless lock 32 that includes a relief apertures 46, 52 for receiving the extension portion 94 of the interior trim 26. In this embodiment, the overlap portion 96 of the extension portion 94 may extend within relief apertures 46 and 52 for a snug fit connection.

Additionally, in another embodiment, the first plugless lock 32 illustrated by FIGS. 3B, 3C, 15A, 15B and 15C include apertures 102A, 102B positioned along sidewalls 104A, 104B that extend from the base 36 and between the first side 44 and the second side 50. These side apertures 102A, 102B are configured to receive the first and second clips of the second plugless lock 36 illustrated by FIGS. 6A and 6B.

Further, as illustrated by FIGS. 15A, 15B, 15C, and 15D, a locating feature is provided wherein the second ends 70, 78 of the first flange 60 and second flange 62, respectively, may be inserted into the mating profile 90 along an underside 92 of the interior trim 26. In this embodiment, the matting profile 90 includes a first rib 110 and a second rib 112. The first and second ribs 110, 112 extend along the underside 92 and are spaced from one another along the underside 92 of the interior trim 26. The ribs 110, 112 may define a space that includes at least one slot 114 and a shoulder 116 therein. The first groove 72 may be configured to be received within the slot 114 while the remaining portion of the second ends 70, 78 may abut against the shoulder 116. This embodiment allows a user to quickly locate the proper position of the second plugless lock 34 relative to the interior trim 26 without risk of unwanted relative rotation.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

The invention claimed is:

1. A plugless locking system for attaching trim over a space between a glazing member and a framing member, the plugless locking system comprising:

a first plugless lock configured to attach to an exterior trim, the first plugless lock comprising:

a base having an exterior side and an opposite interior side, the exterior side of the base is configured to attach to the exterior trim;

a first member extending from the interior side of the base;

a second member extending from the interior side of the base;

a cavity defined by the base, the first and second members;

a first arm extends from the first member, the first arm is configured to operatively engage the glazing member;

a second arm extends from the second member, the second arm is configured to operatively engage a surface of the framing member;

at least one aperture within the first plugless lock; and a second plugless lock configured to attach to an interior trim, wherein the second plugless lock attaches with the first plugless lock, the second plugless lock comprising:

a branch configured to be at least partially received within the cavity of the first plugless lock;

at least one flange member extending from the branch, the at least one flange member is configured to operatively engages the aperture to attach the second plugless lock with the first plugless lock;

wherein the interior trim and the exterior trim may be positioned over the space between the glazing member and the framing member;

wherein a first fastener attaches the first plugless lock to the exterior trim and a second fastener attaches the second plugless lock to the interior trim wherein the fasteners are concealed by the plugless locking system once the plugless locking system is installed within the space between the glazing member and the framing member and the fasteners are contained within the first and second plugless locks.

2. The plugless locking system of claim 1 wherein the second plugless lock includes a first flange member and second flange member wherein the first flange member includes a first end having a clip and a second end including a groove and the second flange member includes a first end having a clip and a second end including a groove.

3. The plugless locking system of claim 2 wherein the grooves are configured to abut against a mating profile of the interior trim to support the second plugless lock relative to the interior trim.

4. The plugless locking system of claim 1 wherein the branch includes a first flange member spaced from a second flange member, the first flange member includes a first clip configured to operatively engage a first aperture of the first plugless lock and the second flange member includes a second clip configured to operatively engage a second aperture of the first plugless lock.

5. The plugless locking system of claim 4 wherein the first flange member further comprises a first groove extending from the branch opposite from the first clip and the second flange member further comprises a second groove extending from the branch opposite from the second clip.

6. The plugless locking system of claim 2 wherein the grooves are configured to abut against a mating profile of the interior trim to support the second plugless lock relative to the interior trim.

7. The plugless locking system of claim 4 wherein the first clip and second clip are configured to bias relative to one another to operatively attach to the first and second apertures, respectively.

8. The plugless locking system of claim 6 wherein the mating profile includes a space defined by a first rib and a second rib.

9. The plugless locking system of claim 6 wherein the mating profile includes a ridge that extends along the underside of the interior trim.

10. A locking system for attaching trim over space between a glazing member and a framing member, the locking system comprising:

a first lock configured to attach to an exterior trim, the first lock comprising:

a base having an exterior side and an opposite interior side, the exterior side of the base is configured to attach to the exterior trim;

first and second members extending from the interior side of the base;

a cavity defined by the base and the first and second members;

a first arm extending from the first member, the first arm is configured to operatively engage the glazing member;

a second arm extending from the second member, the second arm is configured to operatively engage the framing member;

at least one aperture within the first lock; and a second lock configured to attach to an interior trim, wherein the second lock attaches with the first lock, the second lock comprising:

a branch at least partially received within the cavity of the first lock;

at least one flange member extending from the branch, the at least one flange member operatively engages the aperture attaching the second lock with the first lock;

wherein a first fastener attaches the first lock to the exterior trim and a second fastener attaches the second lock to the interior trim wherein the fasteners are concealed by the first and second lock once operatively installed and the fasteners are contained within the first and second locks.

11. The locking system of claim 10 wherein the second lock includes a first flange member and second flange member wherein the first flange member includes a first end having a clip and a second end including a groove and the second flange member includes a first end having a clip and a second end including a groove.

12. The locking system of claim 11 wherein the grooves are configured to abut against a mating profile of the interior trim to support the second lock relative to the interior trim.

13. The locking system of claim 10 wherein the branch includes a first flange member spaced from a second flange member, the first flange member includes a first clip configured to operatively engage a first aperture of the first lock and the second flange member includes a second clip configured to operatively engage a second aperture of the first lock.

14. The locking system of claim 13 wherein the first flange member further comprises a first groove extending from the branch opposite from the first clip and the second flange member further comprises a second groove extending from the branch opposite from the second clip.

15. The locking system of claim 11 wherein the grooves are configured to abut against a mating profile of the interior trim to support the second lock relative to the interior trim.

16. The locking system of claim 15 wherein the first clip and second clip are configured to bias relative to one another to operatively attach to the first and second apertures, respectively.

17. The locking system of claim 15 wherein the mating profile includes a space defined by a first rib and a second rib.

18. The locking system of claim 15 wherein the mating profile includes a ridge that extends along the underside of the interior trim.

* * * * *